US005274880A

United States Patent [19]

Ohshima

[11] Patent Number: 5,274,880

[45] Date of Patent: Jan. 4, 1994

[54] DOOR CLOSER

[75] Inventor: Kazuyoshi Ohshima, Tokyo, Japan

[73] Assignee: Sugatsune Industrial Co., Ltd., Tokyo, Japan

[21] Appl. No.: 778,102

[22] PCT Filed: Feb. 22, 1991

[86] PCT No.: PCT/JP91/00227

§ 371 Date: Dec. 13, 1991

§ 102(e) Date: Dec. 13, 1991

[87] PCT Pub. No.: WO91/18174

PCT Pub. Date: Nov. 28, 1991

[30] Foreign Application Priority Data

May 23, 1990 [JP] Japan ..... 2-133134

[51] Int. Cl.[5] ..... E05F 3/14; E05F 3/22

[52] U.S. Cl. ..... 16/65; 16/52; 16/49

[58] Field of Search ..... 16/49, 51-

[56] References Cited

U.S. PATENT DOCUMENTS

| | | | |
|---|---|---|---|
| 2,472,508 | 6/1949 | Allen | 16/65 |
| 3,543,327 | 12/1970 | Nilsson | 16/49 |
| 3,579,709 | 5/1971 | Pierie | 16/65 |
| 4,491,355 | 1/1985 | Marinoni | 292/263 |
| 4,564,973 | 1/1986 | Kordes | 16/49 |
| 4,879,785 | 11/1989 | Tolle et al. | 16/82 |
| 5,111,548 | 5/1992 | Ohshima | 16/52 |

FOREIGN PATENT DOCUMENTS

| | | | |
|---|---|---|---|
| 98293 | 5/1924 | Austria | 16/65 |
| 405684 | 9/1943 | Italy | 16/80 |
| 412531 | 12/1945 | Italy | 16/65 |
| 50-39621 | 11/1975 | Japan | 16/65 |
| 52-5486 | 2/1977 | Japan | 16/65 |
| 55-23245 | 2/1980 | Japan | 16/65 |

*Primary Examiner*—Lowell A. Larson
*Assistant Examiner*—Donald M. Gurley
*Attorney, Agent, or Firm*—Jacobson, Price, Holman & Stern

[57] ABSTRACT

A door closer having a return spring for accumulating a recovering force in a door closing direction at the time of opening a door for performing a braking force by a damper at the time of closing the door which comprises a closer body internally containing a mechanism for performing an operation as the damper in a body case, an adjusting arm coupled perpendicularly to a driving shaft for the damper of the closer body to be projected laterally rotatably, a coupling bracket for pivotally securing an upper frame mounting plate directly or indirectly to the end of the adjusting arm via step screws to be horizontally rotatable, and a door mounting arm projected laterally from the closer body for pivotally securing a door mounting bracket to the end of the arm via a step screw to be horizontally rotatable. Thus, the door closer can obviate a concept of mounting the closer body at the door to eliminate necessity of mounting a large closer body at the door by disposing a closer body as a damper at the pivotally securing position of the arm and the adjusting arm, thereby deleting impossibility of mounting the door closer even at a glass engaging door.

2 Claims, 7 Drawing Sheets

DOOR CLOSER

BACKGROUND OF THE INVENTION

1. Field of the Invention

This invention relates to a door closer in which a recovering force is accumulated in a door closing direction at the time of opening a door and a braking force of a damper is performed at the time of closing the door and, more particularly, to a device for automatically closing a door by mounting a closer body having a function of a damper at the door and an upper frame through arms.

2. Description of the Prior Art

A conventional door closer consists, as shown in FIGS. 9 and 10 showing the using state of a door closer, of a closer body a, an arm c fixed at one end thereof to a piston driving shaft b of the door closer body a, and an adjusting arm g pivotally secured at one end thereof to the end of the arm c via a screw d, etc., and pivotally secured at the other end thereof to a mounting plate e via a screw f, etc., The door closer body a has a hydraulic cylinder (not shown) in a body case a', and a piston (not shown) telescopically inserted into the hydraulic cylinder through a return spring.

In order to use the door closer of the arrangement described above, the closer body a is clamped at the upper portion of a door j openably pivotally secured via a hinge i at the hanging side to a vertical frame h through one or more clamping screws k, and the mounting plate e is clamped at an upper frame l via one or more clamping screws (not shown). In this manner, the piston is telescopically driven against the return spring by the piston driving shaft b rotated by both the arms by the door opening operation, the recovering force is accumulated at the return spring, and the door j is so mounted as to be automatically closed by the accumulated recovering force accumulated at the return spring.

In the door closer described above, the closer body a and the mounting plate e are respectively mounted at the door j and the upper frame l in a door closing state. In this case, the door closer is so mounted that a recovering force of certain degree is accumulated at the return spring even at the time of closing the door by considering a latching in the door closing state.

However, according to the conventional door closer, a considerably large closer body a must be mounted in the vicinity of the upper frame l of the door j. Therefore, in case of a narrow mounting space like a glass engaging door, the door closer might be sometimes impossible to be mounted at the door.

Further, in order to fully open the door in a direction of an arrow m from the door closing state in FIG. 9, the piston driving shaft b must be rotated at a considerably large rotating angle by the arm c. Accordingly, the internal structure of the door closer body a must be so composed as to be allowed to be rotatable at the large angle. This considerably restricts the degree of freedom of the door closer body a in design.

In contrast, in view of the arm crossing angle $\alpha$ formed between the arm c and the adjusting arm g in FIG. 9, as the door is opened, the crossing angle $\alpha$ is gradually increased. When the door is fully opened, the crossing angle $\alpha$ is arrived at the maximum value. As a result, when a hand is released from the door j in the door fully opening state, the door j is closed by the recovering force accumulated at the return spring. If the door is intended to be held in a door opening state, another suitable stopper mechanism must be arranged.

The conventional door closer further has the following disadvantage. A closer body a and a mounting plate e are fixed directly to a door j and an upper frame l in a state that all components are assembled completely. At this time, since arms c and g are rotatably energized in a direction of an arrow m in FIG. 9 by the recovering force accumulated at a return spring, the mounting positioning and the mounting works of the closer body a and the mounting plate e are not so easy, but long time and labor are wasted.

In case of a repair when the closer body a is defective, an inspection and a maintenance of the closer body a, not only the closer body a but the mounting plate a must be removed. Therefore, when they are again mounted, there arise problems such as an alteration of mounting positions by considering insufficient strength of clamping of clamping screws due to looseness of holes to be again clamped with the screws, exposure of old screw holes to deteriorate a design feeling in external appearances of the door and the upper frame, etc.

SUMMARY OF THE INVENTION

A primary object of the present invention is to provide a door closer which can eliminate the problems of the conventional door closer and can obviate a concept of mounting a closer body at a door to eliminate necessity of mounting a large closer body at the door by disposing a closer body as a damper at the pivotally securing position of an arm and an adjusting arm, thereby deleting impossibility of mounting the door closer even at a glass engaging door.

Another object of the present invention is to provide a door closer which can improve the degree of freedom of a closer body in design thereof by reducing a large rotating angle of a damper driving shaft of the closer body to a relatively small value to open a door from a door closing state to a door fully opening state.

Still another object of the present invention is to provide a door closer which can gradually reduce an arm crossing angle between an arm and an adjusting arm immediately before a door fully opening state by establishing the arranging position of a closer body as described above thereby to decrease a recovering force of a return spring in a door closing direction, thereby holding the door in the door fully opening state even without stopper mechanism.

In order to achieve the above-described and other objects of the present invention, according to first aspect of the invention, the arm and the adjusting arm of the door closer are disposed at the upper and lower surfaces thereof in the same plane. Further, according to second aspect of the invention, a stepwise difference between the upper surfaces of the arm and the adjusting arm is equal to the stepwise difference between the lower surfaces of the arm and the adjusting arm of the door closer. Thus, one type of door closer may be used in both a right-hand side openable door and a left-hand side openable door. In addition, in this case, a speed adjusting screw of the door is exposed on both the upper surface and the lower surface of the closer body of the door closer. Thus, the speed of the door closer of both the right-hand side openable type and the left-hand side openable type can be regulated by using a screwdriver from below.

According to third aspect of the present invention, a pivotally securing position of an adjusting arm as a joint is provided with respect to the door closer, and the door closer can thus be extremely easily and rapidly fixed at a predetermined position to the door and the upper frame. Further, while door mounting fittings and an upper frame mounting plate remain removably attached to the door and the upper frame, only the closer body and both the arm and the adjusting arm can be easily detached, thereby facilitating an inspection, a maintenance and a repair, etc., of the closer body.

In order to perform the above and other objects, there is provided according to first aspect of the present invention a door closer having a return spring for accumulating a recovering force in a door closing direction at the time of opening a door for performing a braking force by a damper at the time of closing the door comprising a closer body internally containing a mechanism for performing an operation as said damper in a body case, an adjusting arm coupled perpendicularly to a driving shaft for the damper of said closer body to be projected laterally rotatably, a coupling bracket for pivotally securing an upper frame mounting plate directly or indirectly to the end of said adjusting arm via step screws to be horizontally rotatable, and a door mounting arm projected laterally from said closer body for pivotally securing a door mounting bracket to the end of said arm via a step screw to be horizontally rotatable.

According to second aspect of the present invention, there is provided a door closer having a return spring for accumulating a recovering force in a door closing direction at the time of opening a door for performing a braking force by a damper at the time of closing the door comprising a closer body internally containing a mechanism for performing an operation as said damper in a body case, an adjusting arm coupled perpendicularly to a driving shaft for the damper of said closer body to be projected laterally rotatably, a coupling bracket for pivotally securing an upper frame mounting plate directly or indirectly to the end of said adjusting arm via step screws to be horizontally rotatable, a door mounting arm projected laterally from said closer body for pivotally securing a door mounting bracket to the end of said arm via a step screw to be horizontally rotatable, whereby the upper surfaces and lower surfaces of said adjusting arm and said arm are formed in the same plane, or stepwise differences between the upper surfaces and lower surfaces of said adjusting arm and said arm are formed to be equal to each other, a speed adjusting screw at the time of closing the door is penetrated through said closer body to be exposed on the upper and lower surfaces thereof.

According to the third aspect of the present invention there is provided a door closer having a return spring for accumulating a recovering force in a door closing direction at the time of opening a door for performing a braking force by a damper at the time of closing the door comprising a closer body internally containing a mechanism for performing an operation as said damper in a body case, an adjusting arm coupled perpendicularly to a driving shaft for the damper of said closer body to be projected laterally rotatably, said adjusting arm is pivotally secured at a base end thereof to be vertically rotatable longitudinally of said driving shaft, an upper frame mounting plate pivotally secured to a coupling bracket vertically rotatably provided at the end of said adjusting arm via a step screw to be horizontally rotatable and removable, and a door mounting arm projected laterally from said closer body for pivotally securing a door mounting bracket to the end of said arm via a step screw to be horizontally rotatable.

Operation

According to the door closer of the third aspect of the invention, the door mounting bracket is clamped at the upper portion of the door at the handing side to be pivotally secured to the vertical frame to be openably via the hinges. On the other hand, the upper frame mounting plate is mounted at the position corresponding to the door mounting bracket on the rear surface of the upper frame via the screw.

Then, the end of the arm fixed to the body case is pivotally secured to the door mounting bracket via the step screw to be horizontally rotatable.

On the other hand, the adjusting arm rotatably coupled perpendicularly to the driving shaft is pivotally secured at the end thereof to the upper frame mounting plate via a step screw to be horizontally rotatable, thereby completing the mounting of the closer body.

When the door mounted by the door closer is opened by rotation, the adjusting arm is rotated in the same direction as the door opening direction, while the arm fixed to the body case is rotated reversely. As a result, the driving shaft of the damper of the closer body is rotated in a predetermined direction, and driven against the return spring, thereby accumulating a recovering force at the return spring.

When the opening door holding state is released at a predetermined door opening position, the door is automatically closed by the accumulated recovering force of the return spring. However, in this case, the operation of the closer body as the damper is performed by the rotation of the driving shaft, thereby smoothly closing the door.

In the door closer of any of the first to third aspect of the invention, since the door mounting bracket can be sufficiently reduced in size in case of the above-described mounting work, even if the door closer mounting portion of the door is narrow, the door closer can be easily mounted.

Further, since the closer body is arranged at the pivotally securing position of the arm and the adjusting arm in case of opening and closing the door, it is not necessary to rotate the driving shaft of the closer body over a considerably large rotating angle. Thus, the degree of freedoms in design of the closer body is increased, and the door closer can be reduced in size, and manufactured in a light weight.

In case of opening the door in the above case, when the door is fully opened, the crossing angle between the arm and the adjusting arm is reduced. Therefore, the recovering force of the return spring in the door closing direction is reduced, thereby eliminating the necessity of a special stopper for holding the door in the fully opening state.

According to the second aspect of the invention, the upper and lower surfaces of the arm and the adjusting arm are formed in the same plane, or the stepwise differences of the upper and lower surfaces of the arm and the adjusting arm are equal to each other. Therefore, when the door closer used in the right-hand side door opening type is used to the left-hand side door opening type, the door closer is inverted upside down, and the door mounting bracket pivotally secured to the arm and the adjusting arm and the upper frame mounting plate is attached to the upper surface of the inverted door closer, thereby mounting the door closer on the door and the upper frame without trouble.

The speed adjusting screw at the time of closing the door can be adjusted by a screwdriver from below even after the door closer is inverted upside down.

In the case of the third aspect of the door closer of the invention, the adjusting arm is vertically rotatable longitudinally of the driving shaft at the base end side thereof, and the upper frame mounting plate is provided at the end of the adjusting arm through the coupling bracket vertically rotatable. Therefore, the closer body can be integrally removed with both the arm and the adjusting arm by releasing the pivotal securing of the coupling bracket at the end of the adjusting arm, the upper frame mounting plate and the arm of the body case, the door mounting bracket in the door closing state.

BRIEF DESCRIPTION OF THE DRAWINGS

The above and other objects as well as advantageous features of the invention will become apparent from the following detailed description of the preferred embodiments taken in conjunction with the accompanying drawings.

DESCRIPTION OF THE PREFERRED EMBODIMENTS

Embodiments of the present invention will now be described with reference to the accompanying drawings.

Referring to FIGS. 1 to 4, showing a third aspect of an embodiment of a door closer according to the present invention for the convenience of description, in a bottomed body case 2 formed in a vertical cylindrical shape, a closer body 1 is filled with high viscosity fluid between a rotor (not shown) disposed therein and a stator (not shown) known per se, and liquidtightly sealed with a cover plate, and a driving shaft for a damper (not shown) projecting upward from a central axial hole (not shown) of the cover plate is fixed with a cylindrical cover 3 via a clamping screw 4.

Figure 4:
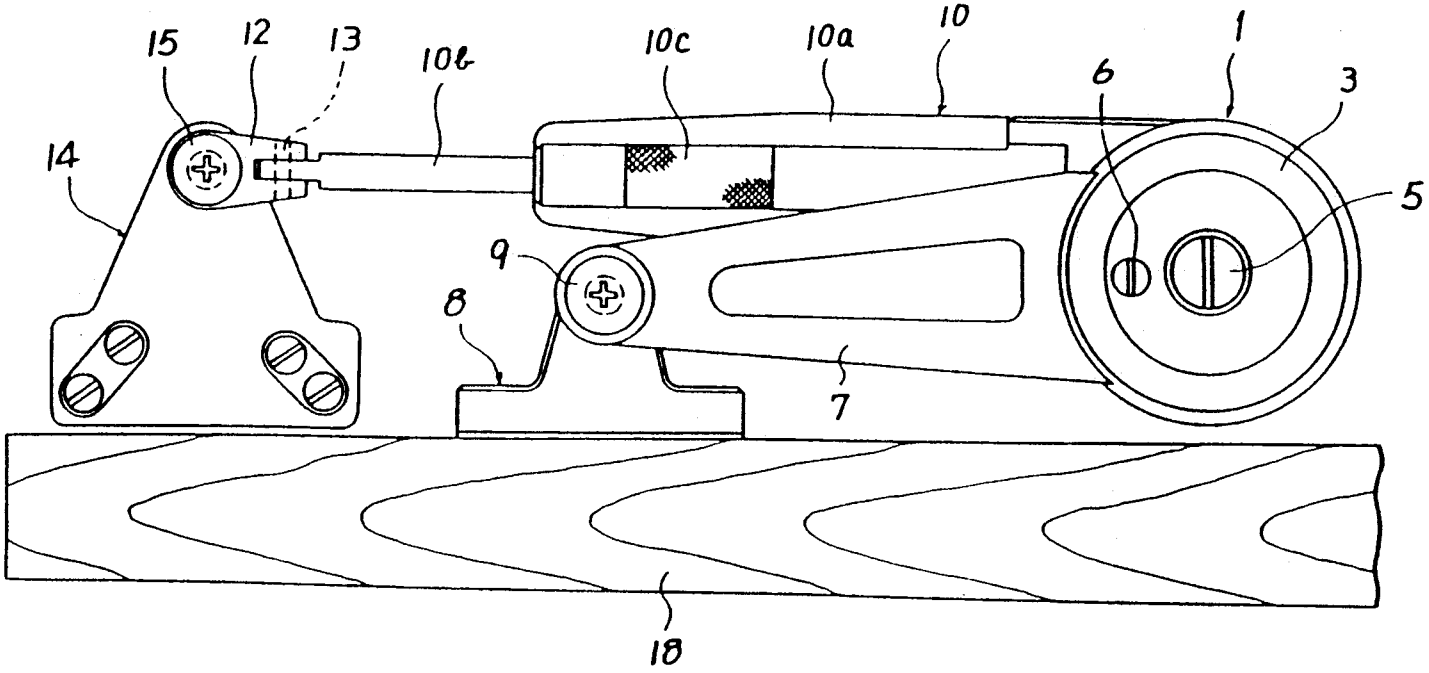

The closer body 1 has, as shown in FIG. 4, a speed adjusting screw 5 and a door opening angle adjusting screw 6, etc., known per se. When the rotor (not shown) is rotated by a driving shaft, and damper effect is performed by the resistance force of the high viscosity fluid between the rotor and the stator. According to the present invention, any members may be employed if the damper effect is performed.

An arm 7 substantially perpendicular to the axial center of the body case 2 of the closer body 1 is projected laterally from the body case 2, and a door mounting bracket 8 of substantially planely T shape is so detachably pivotally secured to the end of the arm 7 via a step screw 9 engaged into the threaded hole **8*a* of the bracket 8 as to be inserted into the through hole 7*a* of the arm 7** to be horizontally rotatable.

Figure 1:
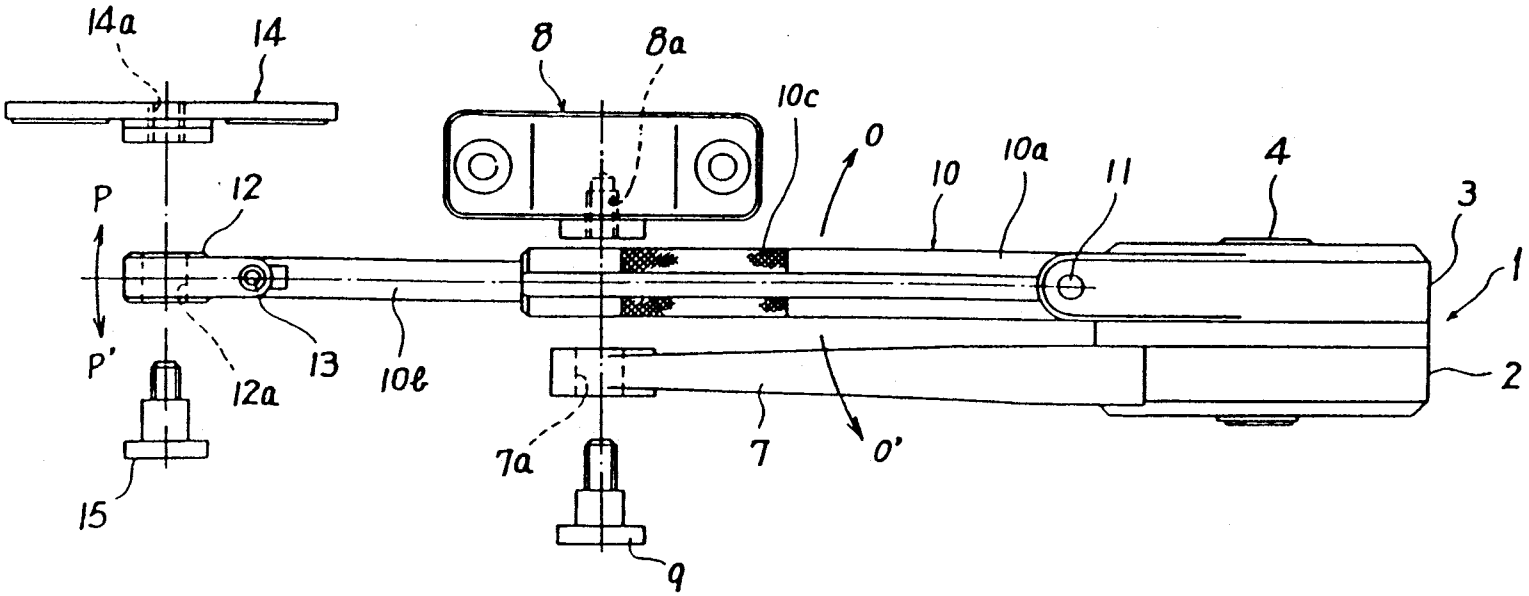
FIG. 1 is a front view showing partly in an exploded state an embodiment of a door closer according to the present invention.
Figure 2:
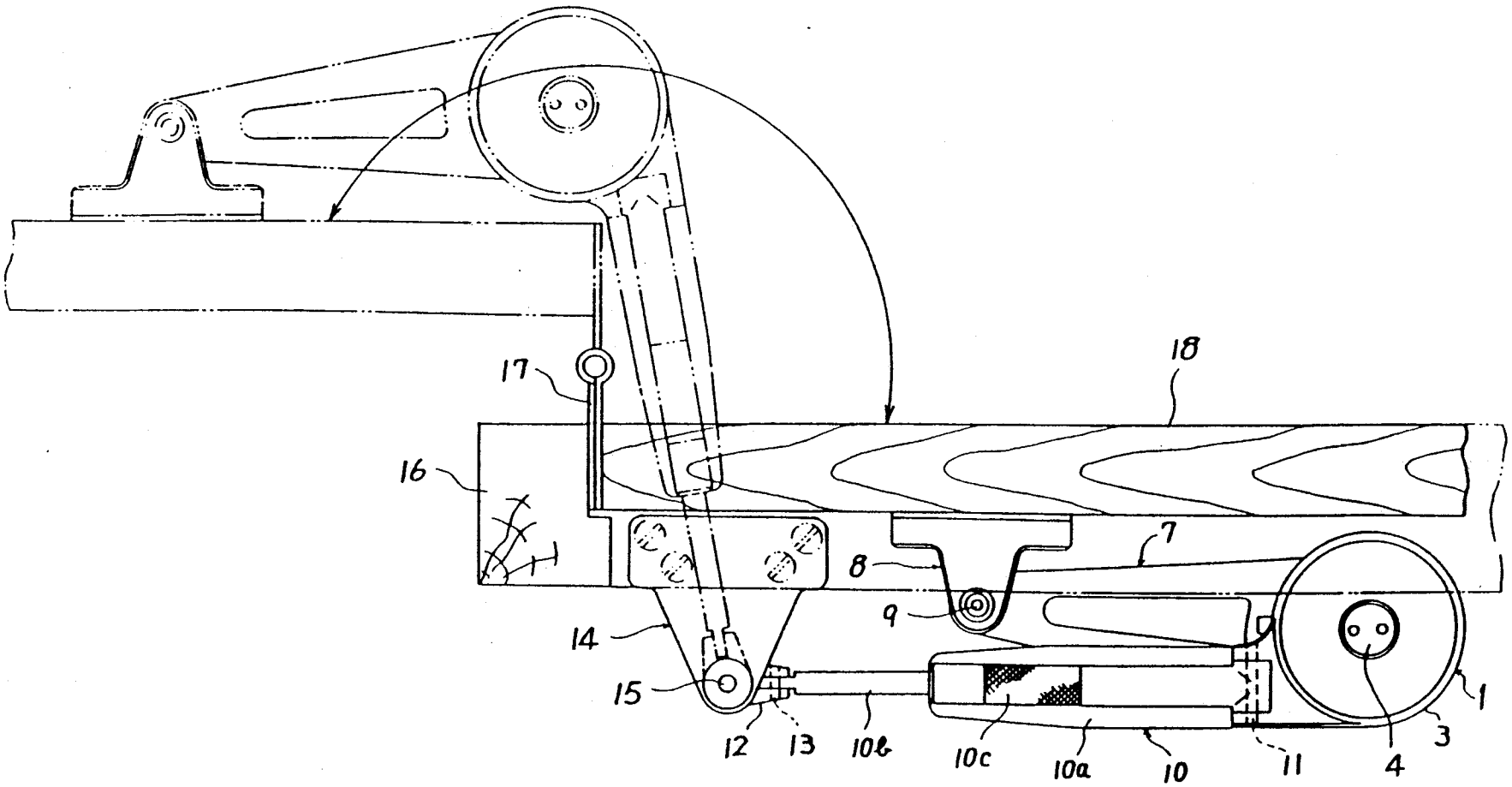
FIGS. 2, 3 and 4 are plan, front and bottom views respectively showing using various states of the embodiment of the door closer.
Figure 3:
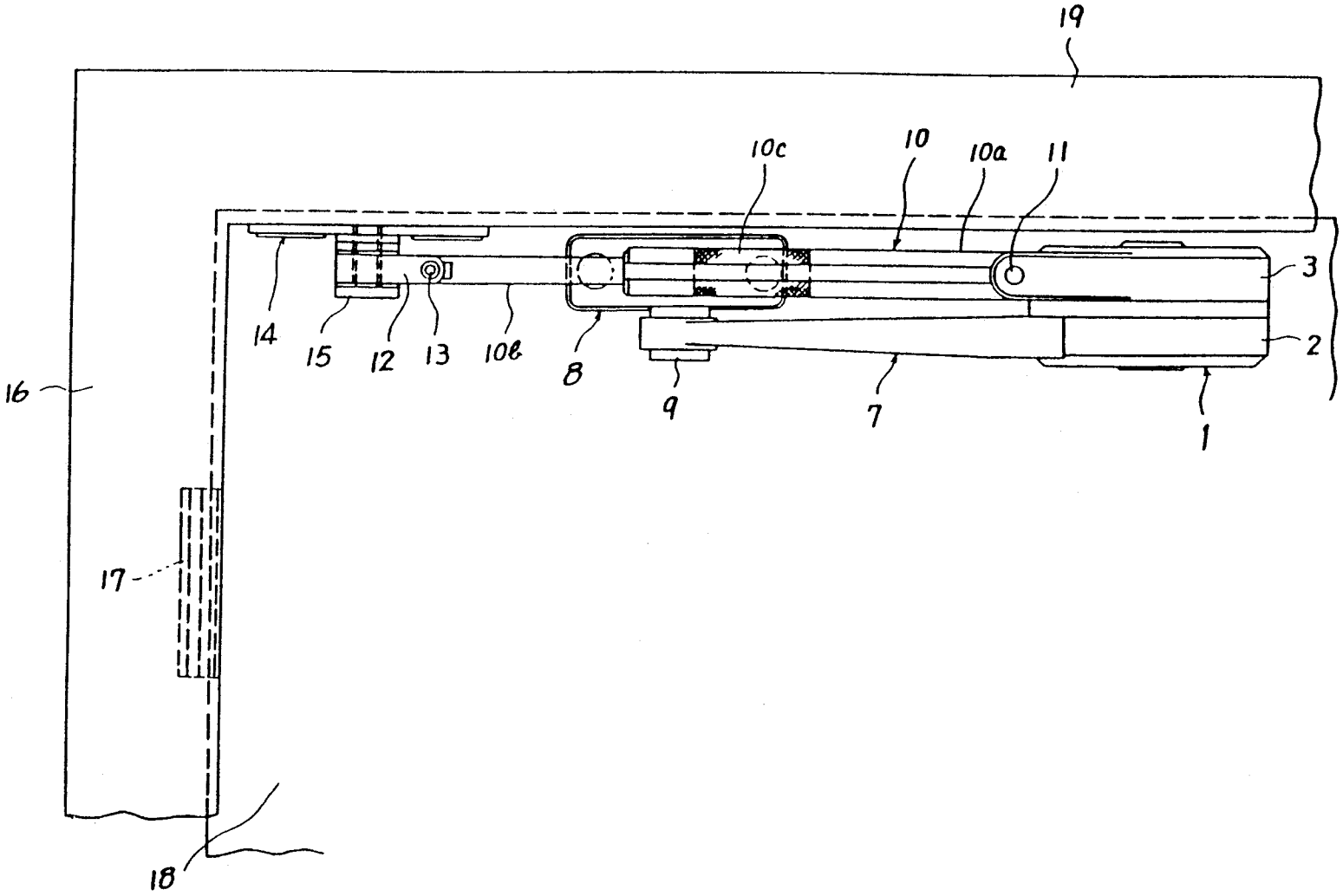

An adjusting screw 10 is laterally projected from the cover 3, and so pivotally secured at a shaft pin 11 as to be vertically upwardly or downwardly rotatable as indicated by arrows O and O' in FIG. 1.

The adjusting arm 10 is formed of an arm body **10*a* pivotally secured at a base end thereof to the cover 3, a threaded lever 10*b* rotatably around an axis thereof and slidable in a longitudinal direction to be inserted into a long hole (not shown) formed longitudinally of the arm body 10*a*, and adjusting threads 10*c* rotatably supported at a home position thereof to the arm body 10*a* and formed threadedly on the threaded lever 10*b*. When the adjusting threads 10*c* are normally or reversely rotated, the threaded lever 10*b* is longitudinally slid with respect to the arm body 10*a*, and the adjusting arm 10 is so constructed that the entire length of the adjusting arm 10** is telescopically adjusted to be elongated or contracted.

In the exemplified example, a coupling bracket 12 is so pivotally secured to the end of the adjusting arm 10, i.e., the end of the threaded lever **10*b* via a shaft pin 13 as to be vertically rotatable as indicated by arrows O and O' in FIG. 1**.

An upper frame mounting plate 14 is so pivotally secured to the end of the adjusting arm 10 as to be inserted into the through hole **12*a* of the coupling bracket 12 and horizontally rotatable and detachable via a step screw 15 engaged within the threaded hole 14*a* of the upper frame mounting plate 14**.

In the door closer constructed as described above, as shown in FIGS. 2 and 3, the door mounting bracket 8 and the upper frame mounting plate 14 are clamped with clamping screws (not shown) at the upper portion of the door 18 and the lower surface of an upper frame 19 at the hanging side pivotally secured openably via hinges 17, . . . , to a vertical frame 16, and the door 18 can be so mounted as to be able to be automatically closed.

The door mounting bracket 8 and the upper frame mounting plate 14 are respectively so secured to the door 18 and the upper frame 19 in a state as to be separated in advance from the arm 7 and the adjusting arm 10 as described above, and the arm 7 and the adjusting arm 10 are thereafter coupled via the step screws 9 and 15, thereby mounting the door closer.

Figure 5:
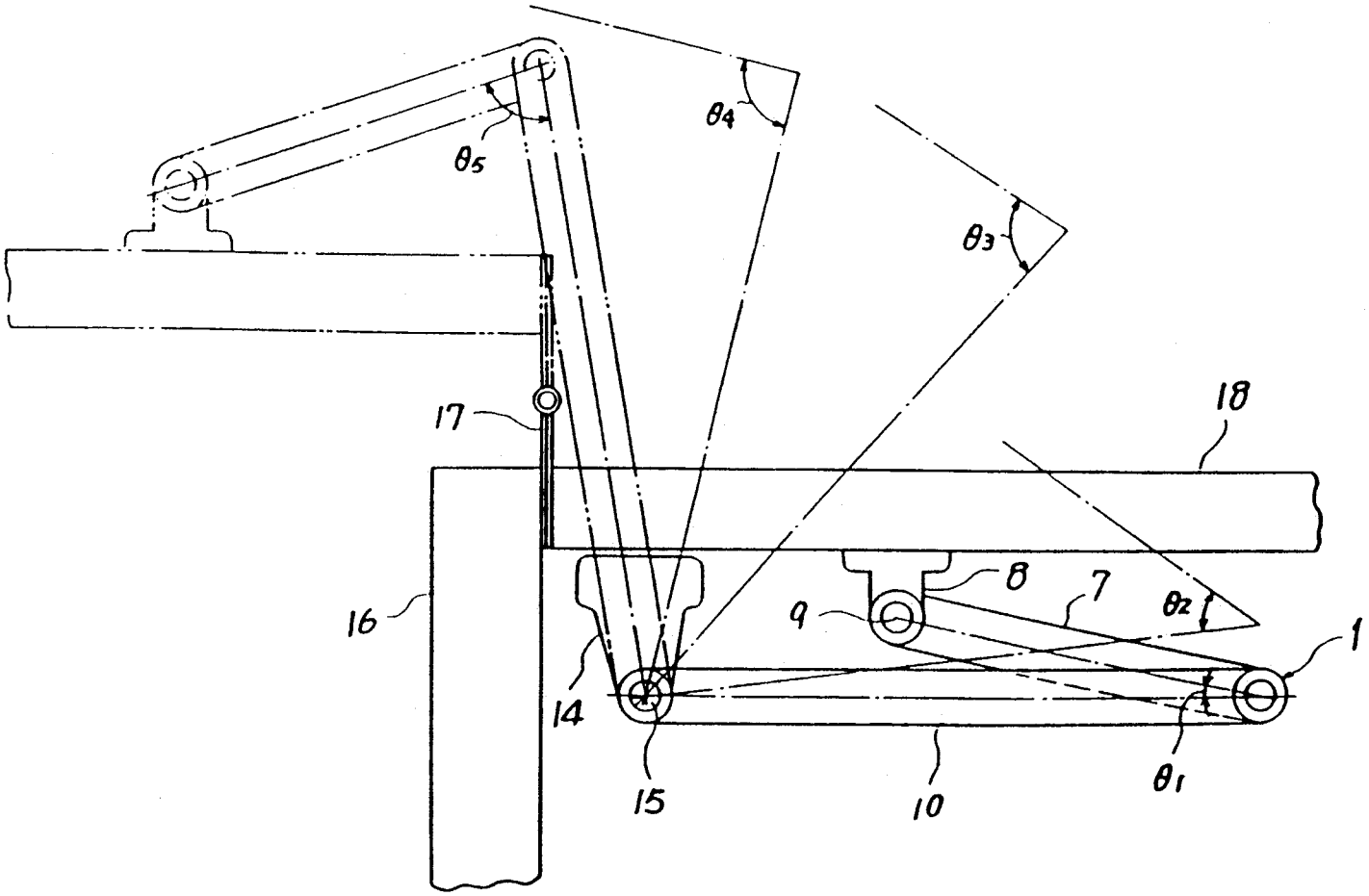
FIG. 5 is an explanatory plan view showing the midway of a door opening state illustrating an example of a first aspect of an embodiment of a door closer.

Referring to FIG. 5, showing a first aspect of an embodiment of a door closer of the invention for the convenience of description, in the door closer, a closer body 1 is not mounted at a door 18, but evidently arranged at a pivotally securing position of an arm 7 and an adjusting arm 10. Further, the adjusting arm 10 is pivotally secured at an end thereof directly to an upper frame mounting plate 14. Therefore, the coupling bracket 12 and the shaft pin 11 provided in the third aspect of the embodiment are not necessarily provided.

Figure 6:
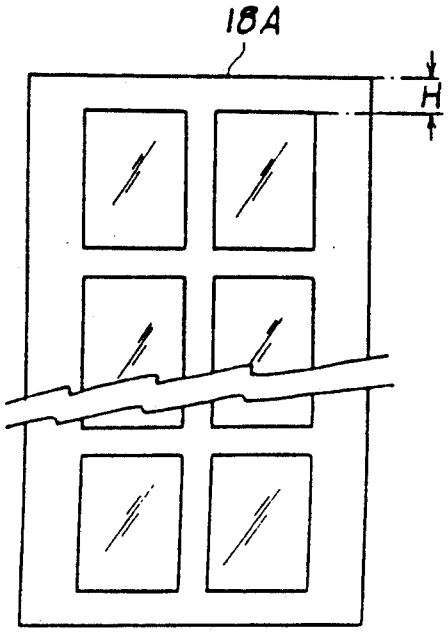
FIG. 6 is a front view partly cut out a glass engaging door to be mounted with a door closer according to the present invention.

Therefore, according to the first aspect of the embodiment of the invention, even if the length H of the upper portion to be mounted with the door closer of a glass engaging door 18A as shown in FIG. 6 is short, it is not necessary to mount the closer body 1 of large size but may mount a door mounting bracket 8 of small size.

As shown in FIG. 5, a crossing angle $\theta_1$ (15°) formed between the arm 7 and the adjusting arm 10 when the door 18 is closed is small, but as the rotating angle of the door is increased at the time of opening the door 18, the crossing angle is sequentially increased like $\theta_2$, $\theta_3$ and $\theta_4$ (135°). Then, when the rotating angle is increased more than a predetermined rotating angle, the crossing angle is reversely decreased, and the crossing angle $\theta_5$=about 80° is obtained in the door fully opening state as shown in FIG. 5.

As a result, a recovering force of a return spring in the door fully opening state is relatively reduced, and the door can be maintained in the door fully opening state without a separate stopping mechanism in the door fully opened state.

It is noted that the return spring can be provided in the closer body 1 known per se, or provided in the adjusting arm 10.

As understood from FIG. 5, the rotating angle of the conventional door (18) is large (180°), but since the crossing angle between the arm 7 and the adjusting arm 10 of the door closer according to the present invention is relatively small, it is not necessary to rotate the damper driving shaft of the closer body 1 at considerably large rotating angle. Thus, when the closer body 1 is composed as the damper, as compared with the case that it is required to be rotated up to 180°, the degree of freedom in design of the door closer according to the present invention can be largely raised.

Figure 7A:
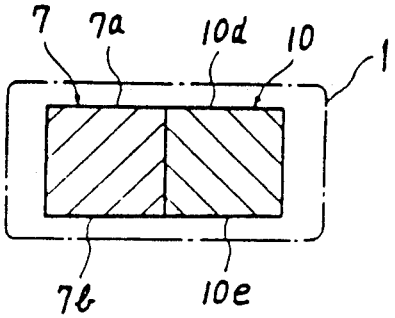
FIG. 7 is an explanatory side view showing longitudinally in section an arm and an adjusting arm of a second aspect of an embodiment of a door closer.
Figure 7B:
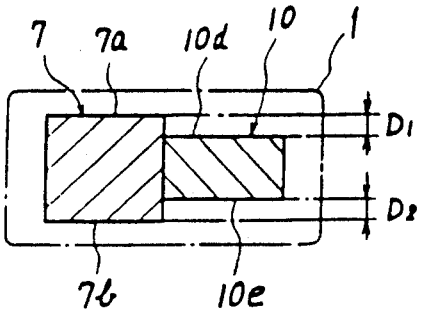
Figure 8:
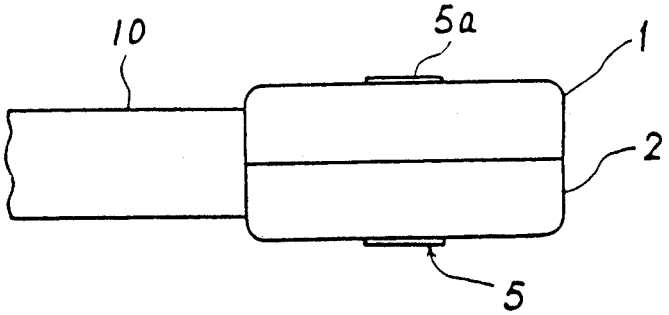
FIG. 8 is a partial schematic side view of the vicinity of a closer body illustrating the door closer of FIG. 7.
Figure 9:
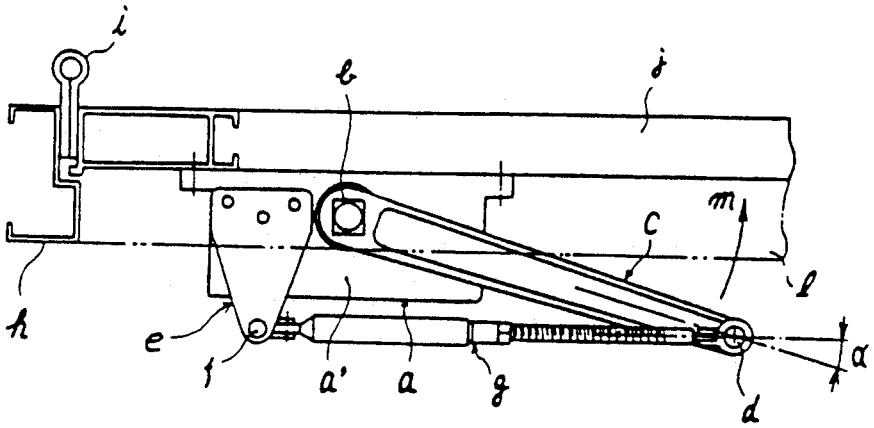
FIG. 9 (PRIOR ART)
FIGS. 9 and 10 are plan and front views respectively showing using states of a conventional door closer.
Figure 10:
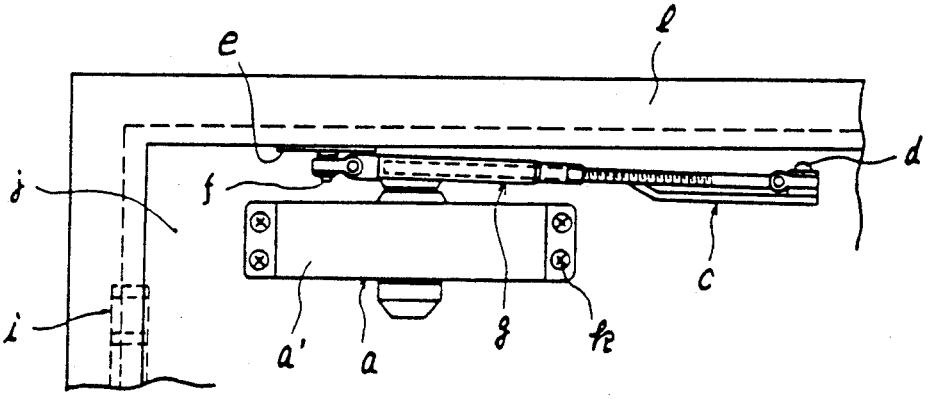
FIG. 10 (PRIOR ART)

FIGS. 7 and 8, show in explanatory side views a second aspect of an embodiment of a door closer of the invention for the convenience of description, in which an arm 7 and an adjusting arm 10 are illustrated in a longitudinal section, wherein FIG. 7(*a*) shows an embodiment different from that in FIGS. 1 to 5, in which the upper surface 7*a* of the arm 7 and the upper surface 10*d* of the adjusting arm 10 are formed in the same height (in the same plane), and the lower surface 7*b* of the arm 7 and the lower surface 10*e* of the adjusting arm 10 are also formed in the same plane.

In the case of FIG. 7(*b*), a stepwise difference D1 between the upper surface 7*a* of the arm 7 and the upper surface 10*d* of the adjusting arm 10 is formed to be substantially equal to a stepwise difference D2 between the lower surface 7*b* of the arm 7 and the lower surface 10*e* of the adjusting arm 10.

As further schematically shown in FIG. 8, in the closer body 1, the adjusting end of a speed adjusting screw 5 at the lower surface of a body case 2 is exposed externally. When the speed adjusting screw 5 is adjustably turned, resistance force of viscous fluid as a damper is controlled not only to adjust the door closing speed, but the adjusting end 5*a* of the speed adjusting screw 5 is exposed on the upper surface of a cover 3.

Therefore, with the arrangement of the door closer described above, the door closer can be used in both a left-hand side door opening type and a right-hand side door opening type.

More specifically, when the door closer is desired to be used in an alternate side door opening type, the door closer may be inverted upside down. In this case, with the arrangement of the door closer described above, when the door closer is inverted upside down, the upper surface 7*a* and the lower surface 7*b* of the arm 7 as well as the upper surface 10*d* and the lower surface 10*e* of the adjusting arm 10 are merely inverted upside down, but the heights of the surfaces are invariable. Therefore, the door 18 can be mounted at the upper frame 19 without trouble by switching the door mounting bracket 9 of the arm 7 and the upper frame mounting plate 14 of the adjusting arm 10 at the upper surface side after they are inverted, and the door closer can be used as it is. Further, when the adjusting end 5*a* of the speed adjusting screw 5 is turned by a screwdriver from below, the door closing speed of the door 18 can be simply adjusted even after the door closer is inverted upside down.

According to the first aspect of the embodiment of the door closer of the present invention constructed as described above, even if the mounting portion of the door with the door closer is narrow, a problem of impossibility of mounting the door closer on the door can be eliminated. Further, the degree of freedom in design of the damper of the door closer can be improved by reducing the rotating angle of the driving shaft of the closer body of the door closer. In addition, since the crossing angle between the arm and the adjusting arm can be reduced in the fully opening state of the door as compared with that of the conventional door closer, it is not necessary to provide a special stopper to maintain the door in the fully opening state.

According to the second aspect of the embodiment of the door closer of the invention as described above, the dimensional arrangement of the arm and the adjusting arm of the door closer is provided, and the speed adjusting screw is exposed on both the upper and lower surfaces of the closer body. Therefore, the door closer can be used in both the right-hand side door opening type and the left-hand side door opening type. In both cases, the door closing speed of the door can be adjusted from below.

According to the third aspect of the embodiment of the door closer of the invention as described above, in addition to the advantages of the first aspect of the door closer, the door mounting bracket and the upper frame mounting plate are removed from the arm and the adjusting arm, and respectively secured directly to the door and the upper frame, and thereafter clamped with the step screws, thereby mounting the door closer. Therefore, since the arm and the adjusting arm are held, rotated against the recovering force of the return spring, and the door mounting bracket and the upper frame mounting plate can be simply coupled in the state that the recovering force is accumulated at the return spring to close the door and to latch it, the door closer can be easily and rapidly mounted reliably at a predetermined mounting position in a short period of time by an easy operation. In addition, in case of an inspection, a maintenance and a repair of a trouble of the door closer, only the door closer can be removed while the door mounting bracket and the upper frame mounting plate remain attached as they are by removing the arm and the adjusting arm from the bracket and the plate. Further, since the remounting of them is facilitated and old threaded holes of the door and the upper frame are not produced, the design feeling of the external appearance of the door and the upper frame is not lost. Moreover, the misalignment of the mounting position of the door closer can be simply adjusted by adjusting the adjusting screw while the door closer remains attached as it is.

What is claimed is:

1. A door closer having a return spring for accumulating a recovering force in a door closing direction at the time of opening a door and a damper for performing a braking force at the time of closing the door, said door closer comprising a closer body including a body case internally containing a mechanism performing a damping operation, a straight adjusting arm coupled perpendicularly and rotatably at one end to said closer body and projecting laterally therefrom, an upper frame mounting plate extending horizontally so as to be secured to a horizontally extending portion of a door frame, a coupling bracket pivotally securing an opposite end of said adjusting arm via a step screw to said upper frame mounting plate so that said adjusting arm is horizontally rotatable, a door mounting bracket extending vertically so as to be secured to a vertical surface of a door mounted in said door frame, a straight door mounting arm projecting laterally at one end from said closer body, a step screw pivotally securing said door mounting bracket to an opposite end of said door mounting arm so that said door mounting arm is horizontally rotatable, said adjusting arm and said door mounting arm overlapping each other in a common vertical plane in a position of rest and forming an arm crossing angle at said closer body when mounted in said door frame so that said arm crossing angle increases to an angle greater than 90° when said door is initially opened and said arm crossing angle ultimately decreases in size to an angle less than 90° as said door approaches a completely open position whereby said closer body maintains said door in said completely open position upon release of said door due to a reduced recovering force on said door as compared to when said arm crossing angle is increasing towards 90°.

2. A door closer having a return spring for accumulating a recovering force in a door closing direction at the time of opening a door and a damper for performing a braking force at the time of closing the door, said door closer comprising a closer body including a body case internally containing a mechanism performing a damping operation, an adjusting arm coupled perpendicularly and rotatably to and projecting laterally therefrom, an upper frame mounting plate adapted to be secured to a horizontally extending portion of a door frame, a coupling bracket pivotally securing an end of said adjusting arm via a step screw to said upper frame mounting plate so that said adjusting arm is horizontally rotatable, a door mounting bracket adapted to be secured to a door mounted in said door frame, a door mounting arm projecting laterally from said closer body, a step screw pivotally securing said door mounting bracket to an end of said door mounting arm so that said door mounting arm is horizontally rotatable, said adjusting arm and said door mounting arm forming an arm crossing angle at said closer body when mounted in said door frame so that said arm crossing angle increases in size when said door is initially opened and ultimately decreases in size as said door approaches a completely open position whereby said closer body maintains said door in said completely open position upon release of said door, a speed adjusting screw extending from an upper surface and a lower surface of said closer body so that said door closer may be used with both a right hand openable and a left hand openable door with access being equally available to said speed adjusting screw from a respective lower surface when said door closer is used with either a right hand openable door or a left hand openable door.

* * * * *